US007000930B2

(12) United States Patent
Smith

(10) Patent No.: US 7,000,930 B2
(45) Date of Patent: Feb. 21, 2006

(54) TANDEM-WHEELED RIDING DEVICE

(76) Inventor: Johnnie L. Smith, 905 E. Main St., Xenia, OH (US) 45385

( * ) Notice: Subject to any disclaimer, the term of this patent is extended or adjusted under 35 U.S.C. 154(b) by 123 days.

(21) Appl. No.: 10/447,902

(22) Filed: May 29, 2003

(65) Prior Publication Data

US 2004/0239065 A1 Dec. 2, 2004

(51) Int. Cl.
*A63C 17/04* (2006.01)

(52) U.S. Cl. ..... 280/87.021; 280/87.042

(58) Field of Classification Search ..... 280/87.01, 280/87.021, 87.03, 87.041, 87.042, 842, 280/843
See application file for complete search history.

(56) References Cited

U.S. PATENT DOCUMENTS

| | | | | | |
|---|---|---|---|---|---|
| 1,874,792 | A | * | 8/1932 | Myers | 472/26 |
| 3,399,904 | A | | 9/1968 | Schinke | 280/87.04 |
| 3,827,706 | A | | 8/1974 | Milliman | 280/11.1 BT |
| 3,856,321 | A | | 12/1974 | Solymosi | 280/87.04 |
| 4,166,630 | A | | 9/1979 | Sullivan et al. | 280/87.02 R |
| 4,323,258 | A | * | 4/1982 | Culpeper | 280/7.12 |
| 4,336,952 | A | * | 6/1982 | Rochman | 280/87.01 |
| 4,460,187 | A | * | 7/1984 | Shimizu | 280/842 |
| 4,691,798 | A | | 9/1987 | Engelbach | 180/209 |
| 4,744,576 | A | | 5/1988 | Scollan, Jr. | 280/87.04 A |
| 4,887,824 | A | * | 12/1989 | Zatlin | 280/87.042 |
| 5,125,687 | A | | 6/1992 | Hwang | 280/842 |
| 5,169,165 | A | * | 12/1992 | Oates | 280/87.03 |
| 5,347,681 | A | * | 9/1994 | Wattron et al. | 16/30 |
| 5,354,081 | A | * | 10/1994 | Huffman et al. | 280/87.01 |
| 5,660,401 | A | | 8/1997 | Yi | 280/11.22 |
| 5,833,252 | A | * | 11/1998 | Strand | 280/87.042 |
| 5,855,385 | A | | 1/1999 | Hambsch | 280/87.042 |
| 5,984,328 | A | | 11/1999 | Tipton | 280/87.042 |
| 6,022,037 | A | | 2/2000 | Code | 280/303 |
| 6,059,303 | A | | 5/2000 | Bradfield | 280/87.042 |
| 6,193,249 | B1 | | 2/2001 | Buscaglia | 280/87.042 |
| 6,237,930 | B1 | | 5/2001 | Code | 280/303 |
| 6,270,096 | B1 | | 8/2001 | Cook | 280/87.042 |
| 6,338,494 | B1 | | 1/2002 | Killian | 280/87.042 |
| 6,428,022 | B1 | | 8/2002 | Namiki | 280/87.042 |

FOREIGN PATENT DOCUMENTS

| | | | |
|---|---|---|---|
| FR | 2 607 713 | * | 6/1988 |
| WO | WO 89/02301 | * | 3/1989 |

* cited by examiner

*Primary Examiner*—Christopher P. Ellis
*Assistant Examiner*—Christopher Bottorff
(74) *Attorney, Agent, or Firm*—Wood, Herron & Evans, LLP

(57) ABSTRACT

A tandem-wheeled riding device includes first and second riding wheel assemblies secured to a bottom surface of a platform for supporting a rider. At least one of the riding wheel assemblies is swivelly coupled to the platform to provide aggressive turning agility to the device. The device further includes at least two outrigger wheel assemblies coupled to the platform and biased toward the riding surface to improve stability of the riding device during sharp turns.

11 Claims, 5 Drawing Sheets

TANDEM-WHEELED RIDING DEVICE

FIELD OF THE INVENTION

The present invention relates generally to self-propelled wheeled vehicles and, more particularly, to tandem-wheeled riding devices.

BACKGROUND OF THE INVENTION

Self-propelled wheeled vehicles, such as skates and skateboards are known in the art. In the past, these devices have employed steerable trucks secured to a platform and supporting pairs of wheels for providing rolling motion to the platform to thereby transport a rider supported thereon. Turning the skate or skateboard generally involves the redistribution of the rider's weight to lean the board or skate and thereby cause the trucks to pivot into the turn. The wheeled trucks are generally adjustable to provide stiff or loose turning action, whereby stiffer turning action of the trucks provides greater stability, but less agility in turning. Conversely, when the trucks are adjusted for looser turning action, the board or skate provides greater turning agility, but less stability.

Over time, the skill level of the general population of riders has increased, generating a demand for boards and skates capable of providing more aggressive performance. The desire for greater speed and improved performance in terms of aggressive turning ability has in turn driven the development of conventional skates and skateboards. In particular, both skates and skateboards have been developed with tandem, or in-line wheels, which generally provide greater turning ability and reduced friction drag compared to wheeled trucks. While in-line skates have become increasingly popular, in-line skateboards are not as prevalent in use. This lag in the proliferation of in-line skateboards is due in part to the difficulty experienced in maintaining stability of the skateboard while maneuvering through a turn.

Moreover, the performance of conventional in-line skates may be improved by increasing the turning ability of the individual skates.

There is thus a need for improved tandem-wheeled riding devices which overcome drawbacks of the prior art, such as those described above.

SUMMARY OF THE INVENTION

The present invention provides a riding device having improved performance in the form of aggressive turning capability while maintaining stability of the device during sharp turns. In one aspect of the invention, a riding platform has first and second riding wheel assembles coupled to a bottom surface. At least one of the riding wheel assemblies has a riding wheel swivelly coupled to the platform to permit very sharp turns to be made when riders redistribute their weight to lean the platform into a turn. The device further includes at least two outrigger wheel assemblies extending laterally outward from the platform. The outrigger wheel assemblies are coupled to the platform for movement relative to the platform, and are biased in a direction toward the riding surface to provide stability to the riding device during deep turns.

According to another aspect of the invention, the outrigger wheel assemblies are configured to be positioned just above the riding surface during forward travel of the device. Accordingly, only the first and second riding wheels are in contact with the riding surface and friction drag of the device is minimized. Advantageously, the outrigger wheel assemblies are caused to engage the riding surface as the platform is leaned to turn the device.

In an exemplary embodiment, the outrigger wheel assemblies are configured to provide increasing resistance to deflection of the outrigger wheel assemblies in directions toward the top surface of the platform as the platform is articulated to turn the riding device. In another exemplary embodiment, the outrigger wheel assemblies are configured to provide constant resistance to deflection of the outrigger wheel assemblies in directions toward the top surface of the platform as the platform is articulated to turn the riding device.

The riding device of the present invention may be provided in various configurations to accommodate different riding formats. In one exemplary embodiment, the riding device is in the form of a tandem-wheeled skateboard. In another exemplary embodiment, the riding device includes a platform configured to support a rider in a recumbent or prone position. In yet another exemplary embodiment, the device includes a platform having two platform sections, each configured to be secured to a foot of a rider, whereby the device is used in the manner of skates.

These and other objects, advantages, and features of the invention will become more readily apparent to those of ordinary skill in the art upon review of the following detailed description of the preferred embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
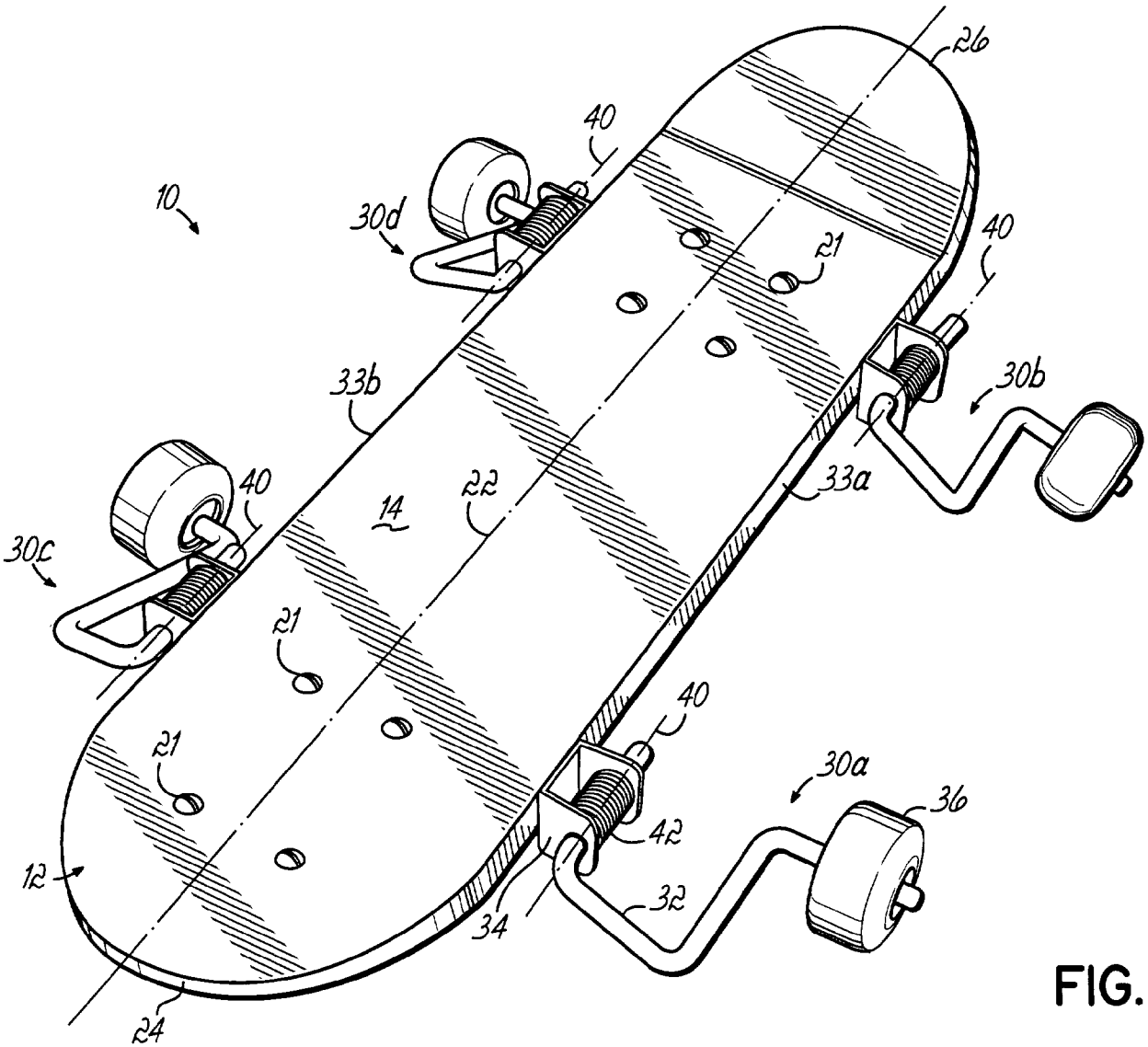
FIG. 1 is a perspective view of an exemplary tandem-wheeled skateboard according to the present invention.
Figure 2:
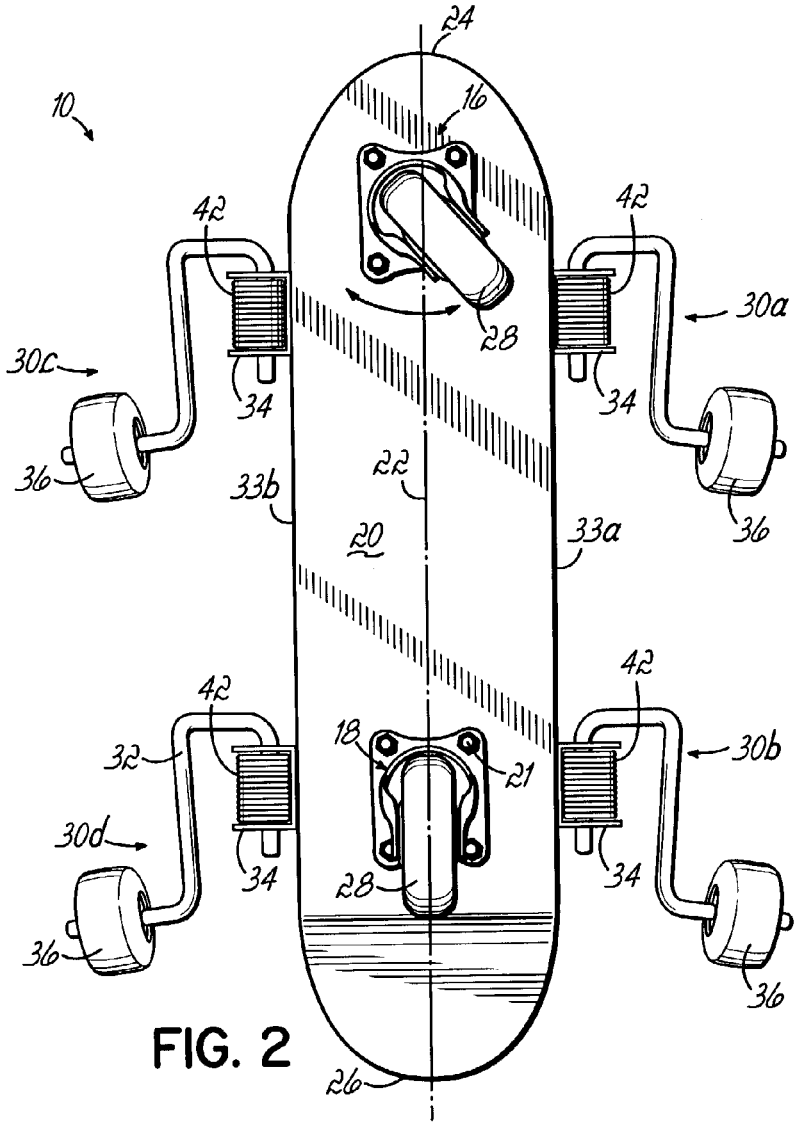
FIG. 2 is a bottom plan view of the tandem-wheeled skateboard of FIG. 1.
Figure 3:
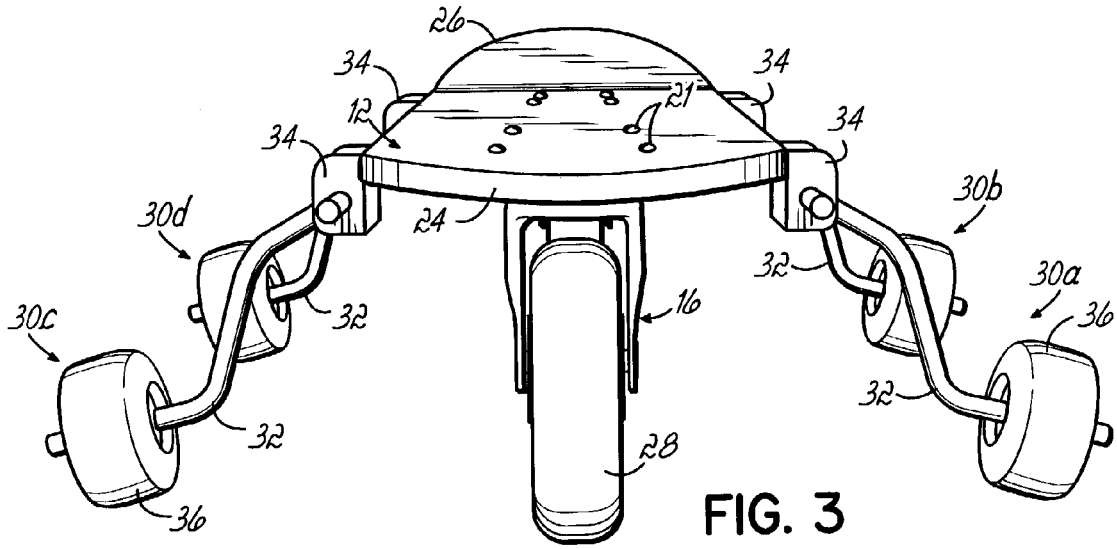
FIG. 3 is perspective end view of the skateboard of FIG. 1.

Referring to FIGS. 1–3, there is shown an exemplary tandem-wheeled skateboard 10 according to one embodiment of the present invention. The skateboard 10 includes an elongate platform 12 having a top surface 14 for supporting a rider. First and second riding wheel assemblies 16,18 (FIG. 2) are secured to the bottom surface 20 of the platform 12 and are spaced along a longitudinal centerline 22 of the platform 12, with the first riding wheel assembly 16 being closer to a leading end 24 of the platform 12, and the second riding wheel assembly 18 being positioned closer to the trailing end 26 of the platform 12. In the exemplary embodiment shown, the first riding wheel assembly 16 has a riding wheel 28 that is swively coupled to the platform 12 to facilitate steering the skateboard 10, and the second riding wheel assembly 18 includes a riding wheel 28 which is secured to the bottom surface 20 of the platform 12 for rotation without swiveling. It will be recognized, however, that the skateboard 10 may be configured such that the first riding wheel assembly 16 rotates without swiveling, while the second riding wheel assembly 18 swivels to facilitate steering of the skateboard 10. Alternatively, both the first and second riding wheel assemblies 16, 18 may be swively coupled to the platform 12 to facilitate steering the skateboard 10.

Figure 4A:
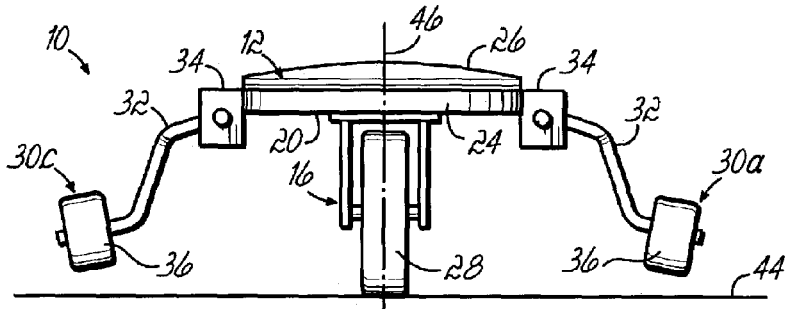
FIGS. 4A–4B are end views of the skateboard of FIG. 1 depicting articulation of the skateboard.

The skateboard 10 further includes four outrigger wheel assemblies 30*a*, 30*b*, 30*c*, 30*d* extending outwardly from the platform 12 and pivotally coupled to the platform 12 for movement in a direction substantially perpendicular to the top surface 14 of the platform 12. Each outrigger wheel assembly 30*a*–30*d* includes an arm member 32 pivotally coupled to the platform 12 by a bracket 34. Outrigger wheels 36 are disposed on the distal ends 38 of the arm members 32 and are coupled to the arm members 32 by low friction bearings (not shown), as known in the art. In the exemplary embodiment shown, the outrigger wheels 36, as well as the riding wheels 28, are formed from urethane, as commonly used in skateboards and skates. The outrigger arm members 32 are secured to opposed lateral edges 33*a*, 33*b* of the platform 12 by brackets 34 to pivot about axes 40 oriented in directions substantially parallel to the top surface 14 of the platform 12. Torsion springs 42 coupled to the arm members 32 and the brackets 34 bias the arm members 32 about pivot axes 40 in a direction toward the bottom surface 20, and toward a forward steering position above a riding surface 44, as depicted in FIG. 4A. Advantageously, the outrigger wheel assemblies 30*a*–30*d* are configured to be suspended just above the riding surface 44 as the skateboard 10 travels in a forward direction such that the platform 12 is carried solely by the first and second riding wheel assemblies 16, 18. Because only the first and second riding wheels 28 contact the riding surface 44, the skateboard 10 exhibits reduced friction drag compared to conventional skateboards which have at least four wheels in contact with the riding surface 44.

While skateboard 10 is shown and described herein as having four outrigger wheel assemblies 30*a*–30*d*, it will be recognized by those skilled in the art that skateboard 10 may alternatively have a pair of outrigger wheel assemblies, one coupled to each side of the platform 12. Alternatively, skateboard 10 may have more than four outrigger wheel assemblies. Furthermore, while the outrigger wheel assemblies are shown and described herein as being pivotally coupled to platform 12 for movement in a direction substantially perpendicular to top surface 14, it will be recognized that outrigger wheel assemblies may be coupled to platform 12 in various other ways for movement relative to the platform 12, while being biased in a direction toward the bottom surface 20.

Figure 4B:
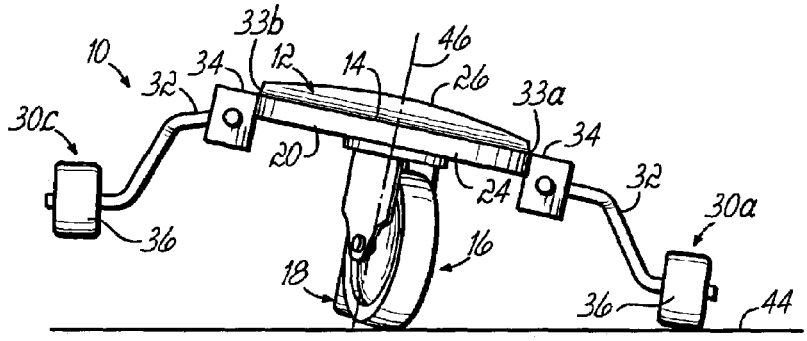

The skateboard 10 exhibits aggressive turning agility while having improved stability, compared to prior tandem-wheeled skateboards. Specifically, and with reference to FIG. 4B, which depicts a turn in the direction of lateral edge 33*a*, as the platform 12 is articulated to cause the skateboard 10 to turn, the first riding wheel assembly 16 swivels about an axis 46 substantially perpendicular to the top surface 14 of the platform 12 to effect a tight turning radius. As the lateral edge of the platform facing into the turn (33*a* in FIG. 4B) is moved in a direction closer to the riding surface 44, due to redistribution of the weight of the rider, the outrigger wheel assemblies 30*a*, 30*b* disposed upon the lateral edge 33*a* of the platform 12 engage the riding surface 44 to provide stability to the platform 12. While operation of the skateboard 10 during a turn in the direction of lateral edge 33*a* has been shown and described, it will be appreciated that outrigger wheel assemblies 30*c*, 30*d* operate in the same manner during a turn in the direction of opposite lateral edge 33*b*.

Because the outrigger wheel assemblies 30*a*–30*d* are biased by torsion springs 42, engagement of the outrigger wheel assemblies 30*a*–30*d* with the riding surface 44 does not cause an abrupt, jarring impact to the skateboard 10. Rather, the outrigger wheel assemblies 30*a*–30*d* provide a smooth resistance to leaning of the platform 12 during a turn. Advantageously, the torsion springs 42 may be selected such that the outrigger wheel assemblies 30*a*–30*d* provide an increasing resistance to deflection of the arm members 32 toward the top surface 14 of the platform 12 whereby increased resistance to deep lateral leaning of the platform 12 provides increased stability to the skateboard 10. Alternatively, the torsion springs 42 may be selected such that a constant resistance to deflection of the outrigger wheel assemblies 30*a*–30*d* is provided when the platform 12 is articulated to effect a turn by moving one of the lateral edges 33*a*, 33*b* in a direction closer to the riding surface 44.

The exemplary skateboard 10 of the present invention thus provides improved performance by permitting aggressive turning of the skateboard 10 while maintaining stability during deep turns. The tandem arrangement of riding wheels and swivel articulation of at least the first riding wheel assembly 16 provides improved turning agility over previous four-wheeled skateboards and fixed wheel in-line skateboards, while the outrigger wheel assemblies 30*a*–30*d* engage the riding surface 44 during deep turns to ensure stability of the skateboard 10.

Figure 5:
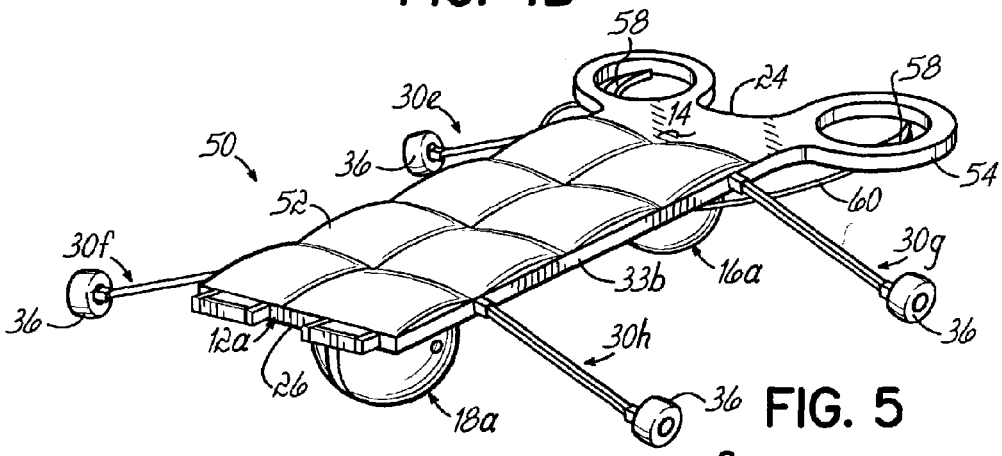
FIG. 5 is a perspective view of a tandem-wheeled riding board, according to yet another embodiment of the present invention.
Figure 6:
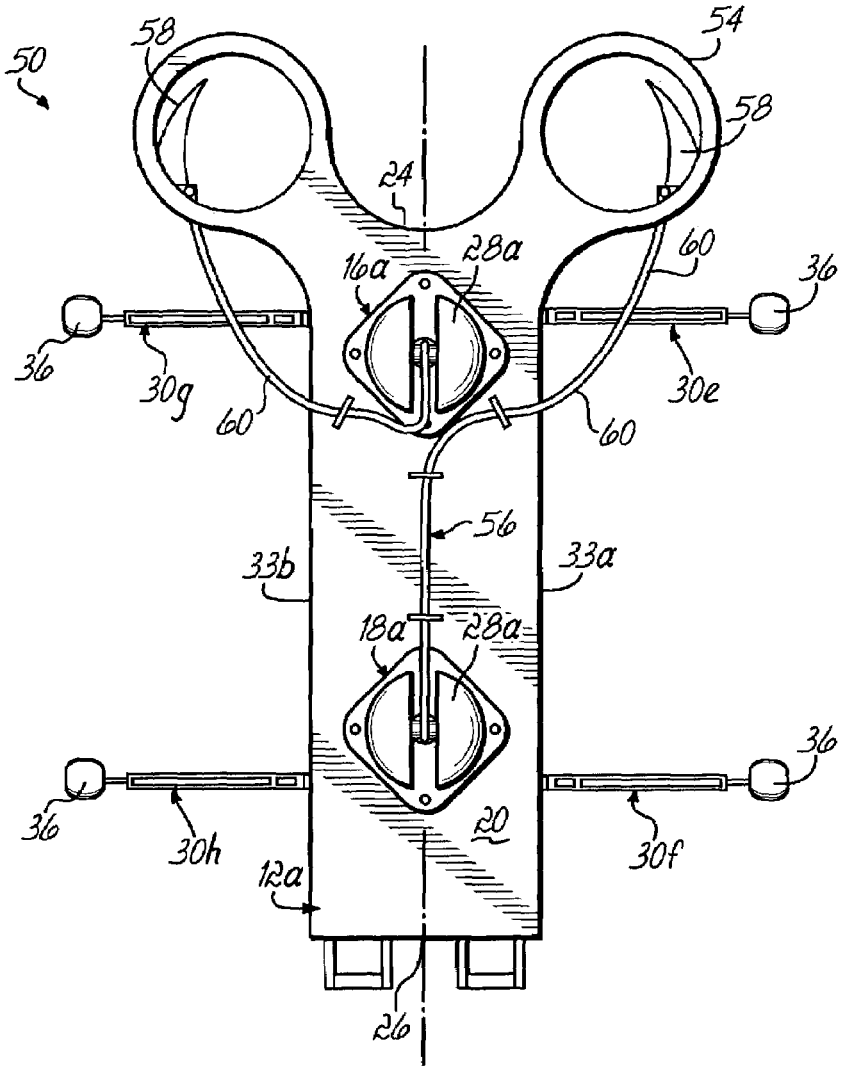
FIG. 6 is a bottom view of the riding board of FIG. 5.

Referring now to FIGS. 5 and 6, there is shown another exemplary riding device 50 of the present invention wherein the platform 12*a* is configured to receive a rider in a recumbent or prone position. This embodiment is particularly suited for use in activities commonly known as "street luge" or "land luge." The riding device 50 of FIGS. 5 and 6 is similar to the skateboard 10 of FIG. 1, and similar components have been similarly numbered. In particular, the riding device 50 includes a platform 12*a* having a top surface 14 for supporting a rider in a prone or recumbent position. To this end, the top surface 14 of the platform 12*a* may be covered, at least partially, with a padding material 52 to provide increased comfort to the rider. First and second riding wheel assemblies 16*a*, 18*a* are secured to the bottom surface 20 of the platform 12*a* along a longitudinal centerline 22, as described above. One or both of the first and second riding wheel assemblies 16*a*, 18*a* includes a wheel 28*a* that is swively coupled to the platform 12*a* to facilitate steering the riding device 50, as discussed more fully above. In the exemplary embodiment shown, the riding wheel assemblies 16*a*, 18*a* include wheels 28*a* which are depicted as being of a different configuration than the wheels 28 of skateboard 10 in FIGS. 1–4. The riding wheels 28, 28*a* shown herein are for exemplary purposes only, and it will be recognized that various other types of wheels may be used.

Four outrigger wheel assemblies 30*e*–30*h* extend outwardly from the platform 12*a* and are pivotally coupled to the platform 12*a* for movement in a direction substantially perpendicular to the platform 12*a* to help maintain stability of the riding device 50 when the platform 12*a* is articulated to effect a turn.

The riding device 50 of FIGS. 5 and 6 further includes handle members 54 that may be grasped by a rider supported on the platform 12*a*. A brake assembly 56 coupled to the first and second riding wheel assemblies 16*a*, 18*a* allows riders to control the speed of the riding device 50 and to stop the riding device 50 as desired. In the exemplary embodiment shown, the brake assembly 56 includes caliper brakes (not shown) selectively engageable with the riding wheels 28*a* and selectively actuateable by brake levers 58 secured to the platform 12*a* proximate the handle members 54. The brake levers 58 are coupled to the caliper brakes by cables 60 whereby the rider may actuate the caliper brakes by depressing the brake levers 58, as known in the art.

Figure 7:
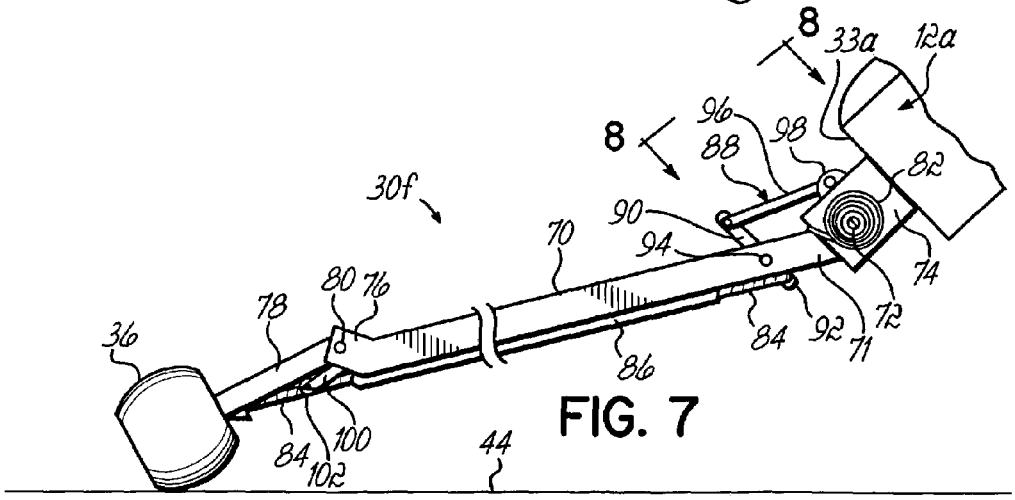
FIG. 7 is a detailed view depicting an outrigger wheel assembly of the board of FIG. 5.

Referring now to FIG. 7, there is shown an alternative embodiment of an outrigger wheel assembly 30*e*–30*h*, as depicted in the riding device 50 of FIGS. 5 and 6. The outrigger wheel assembly shown comprises an arm member 70 that is pivotally coupled at a first end 71 to the platform 12*a* by a shaft member 72 extending through a bracket 74 secured to a lateral edge 33*a*, 33*b* of the platform. An outrigger wheel 36 is supported at a second end 76 of the arm member 70 by an axle 78 that is pivotally coupled to the arm member 70 by a pinned joint 80. In the exemplary embodiment shown, the outrigger wheel 36 is formed from urethane, in a manner similar to conventional skateboard wheels, and is coupled to the axle 78 by frictionless bearings (not shown). The outrigger wheel 36 and arm member 70 are biased in a direction toward the riding surface 44 by a torsion spring 82 secured to the bracket 74. A cable 84 extends from the outrigger wheel 36, through a cable guide 86 provided on the underside of the arm member 70, and is coupled to the torsion spring 82 by an upper linkage assembly 88, as best depicted in FIG. 8.

Figure 8:
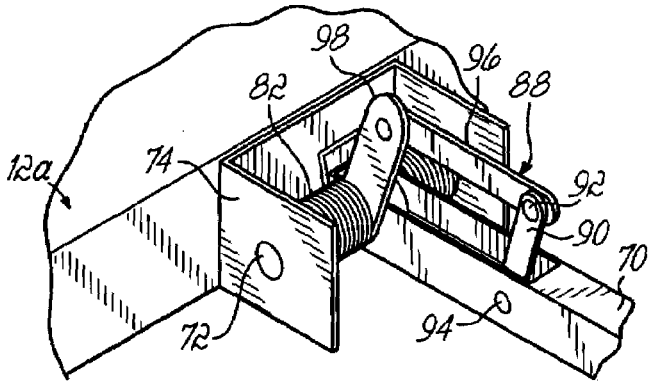
FIG. 8 is a perspective view depicting detail of the outrigger wheel assembly of FIG. 7.

With continued reference to FIGS. 7 and 8, the upper linkage assembly 88 comprises a first linkage 90 secured to cable 84 at a first end 92, and pinned to the arm member 70 at a pinned joint 94, whereby the first linkage 90 may pivot about the pinned joint 94. The first linkage 90 is connected by second and third linkages 96, 98 to the shaft member 72, and the third linkage 98 is coupled to the torsion spring 82 such that the upper linkage assembly 88 is biased by the torsion spring 82 to draw the cable 84 in a direction toward the first end 71 of the arm member 70.

A lower linkage 100 is pivotally coupled to the second end 76 of the arm member 70 by the pinned joint 80 that connects the axle 78 to the arm member 70. A pulley 102 disposed on the lower linkage 100 engages the cable 84 to facilitate articulation of the outrigger wheel 36 via tension in the cable 84 applied by the torsion spring 82 and upper linkage assembly 88. Advantageously, the torsion spring 82 acting through the upper linkage assembly 88 applies tension to the cable 84 to cause the arm member 70 and the outrigger wheel 36 supported on the axle 78 to be biased in a direction toward the riding surface 44. In use, when the riding device 50 is moving in a forward direction, the outrigger wheel assemblies 30*e*–30*h* are configured to be supported just above the riding surface 44. As the platform 12*a* is articulated by the rider to cause the riding device 50 to turn, the outrigger wheel assemblies 30*d*–30*h* disposed on lateral edges 33*a*, 33*b* of the platform engage the riding surface 44 to provide stability to the riding device 50, as described above.

Figure 9:
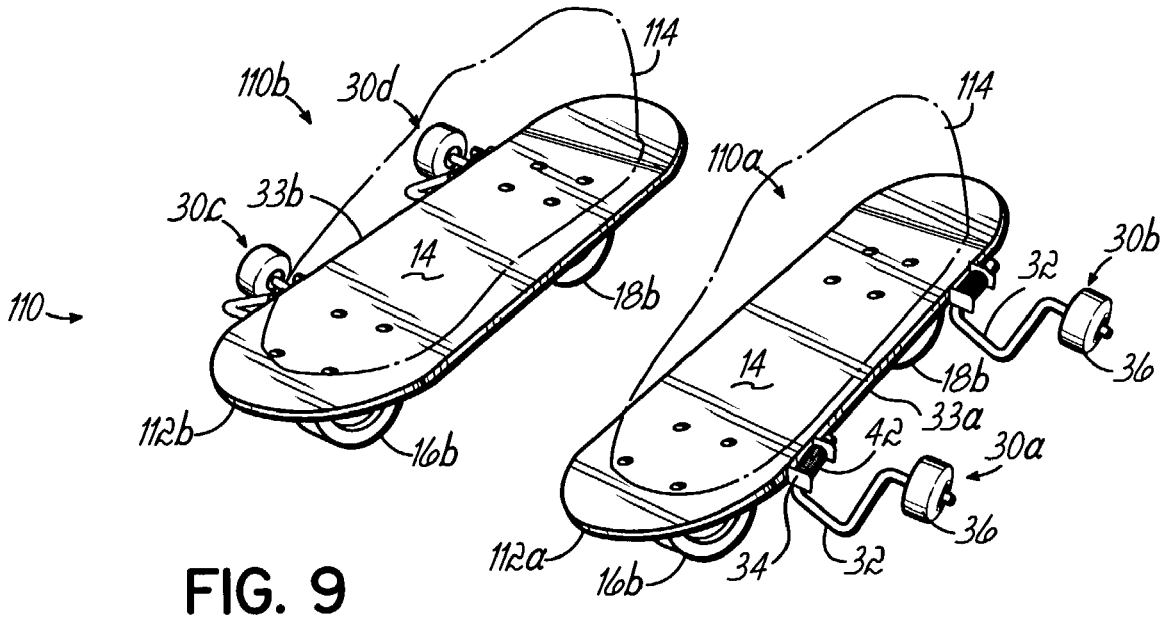
FIG. 9 is a perspective view of another exemplary embodiment of the present invention, in the form of tandem-wheeled skates.

Referring now to FIG. 9, there is shown yet another exemplary embodiment of a riding device according to the present invention, in the form of skates 110 which may be worn by a rider. In this embodiment, the platform 12*b* for supporting a rider comprises first and second platform sections 112*a*, 112*b*, each configured to be coupled individually to a foot 114 of the rider. Each skate 110*a*, 110*b* is constructed in a manner similar to the skateboard 10 of FIG. 1, and similar components are similarly numbered. Each skate 110*a*, 110*b* comprises a platform section 112*a*, 112*b* having a top surface 14 for supporting a foot 114 of the rider. The platform sections 112*a*, 112*b* may be incorporated into the soles of a shoe or boot, or may be configured to be secured to the footwear of a rider, such as by straps or bindings, as known in the art. Each skate 110*a*, 110*b* includes first and second riding wheel assemblies 16*b*, 18*b* secured to the bottom surface 20 of the respective platform sections 112*a*, 112*b*, as described above. The pair of skates 110 further include four outrigger wheel assemblies 30*a*–30*d* , wherein a pair of outrigger assemblies are secured along the outboard lateral edges 33*a*, 33*b* of the respective skates 110*a*, 110*b*. The outrigger wheel assemblies 30*a*–30*d* are pivotally coupled to the outboard lateral edges 33*a*, 33*b* of the platform sections 112*a*, 112*b* and are biased in a direction toward the riding surface 44 to provide turning stability to the individual skates 110*a*, 110*b*, in the manner described above.

While the present invention has been illustrated by the description of one or more embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A tandem-wheeled riding device for transporting a rider over a riding surface, the riding device comprising:

a platform having a top surface for supporting a rider thereupon, and a bottom surface opposite said top surface;

at least first and second riding wheel assemblies disposed on said bottom surface of said platform; and at least two outrigger wheel assemblies extending outwardly from said platform and coupled to said platform for movement relative to said platform, each said outrigger wheel assembly comprising an outrigger arm and an outrigger wheel disposed on a distal end thereof, each said outrigger arm biased in a direction toward the riding surface independently of other ones of said outrigger arms;

wherein said platform includes first and second lateral sides, and wherein at least two outrigger wheel assemblies are coupled to said platform on each lateral side.

2. The riding device of claim 1, wherein at least one of said first and second riding wheel assemblies includes a wheel swively coupled to said platform to facilitate steering the riding device.

3. The riding device of claim 1, wherein said outrigger wheel assemblies are configured to engage the riding surface when said platform is articulated by a rider to steer the riding device into a turn.

4. The riding device of claim 3, wherein said outrigger wheel assemblies are configured to provide increasing resistance to deflection of said outrigger wheel assemblies in a direction toward said top surface of said platform when said platform is articulated to move one of said lateral sides in a direction closer to the riding surface.

5. The riding device of claim 3, wherein said outrigger wheel assemblies are configured to provide constant resistance to deflection of said outrigger wheel assemblies in a direction toward said top surface of said platform when said platform is articulated to move one of said lateral sides in a direction closer to the riding surface.

6. The riding device of claim 1, wherein said platform is configured to receive a rider in a recumbent position thereon.

7. The riding device of claim 6, further comprising a brake assembly coupled to said platform and configured to permit a rider to selectively control the speed of the riding device relative to the riding surface.

8. The riding device of claim 1, wherein each said outrigger wheel assembly comprises an arm member pivotally coupled to said platform, and an outrigger wheel disposed on a distal end of said arm member.

9. The riding device of claim 8, wherein each said outrigger wheel is pivotally coupled to a respective arm member for movement about an axis substantially perpendicular to said arm member.

10. A tandem-wheeled riding device for transporting a rider over a riding surface, the riding device comprising:

a platform having a top surface for supporting a rider thereupon, and a bottom surface opposite said top surface;

at least first and second riding wheel assemblies disposed on said bottom surface of said platform and;

at least two outrigger wheel assemblies extending outwardly from said platform and coupled to said platform for movement relative to said platform, said outrigger wheel assembly assemblies biased in a direction toward the riding surface;

said platform including a longitudinal centerline, a leading end and a trailing end spaced apart along said longitudinal centerline, and opposing lateral sides spaced apart transverse to said longitudinal centerline;

said at least two outrigger wheel assemblies including a first pair of laterally opposed outrigger wheel assemblies each disposed on one of said lateral sides of said platform, and a second pair of laterally opposed outrigger wheel assemblies each disposed on one of said lateral sides of said platform and spaced from said first pair of outrigger wheel assemblies along said longitudinal centerline; and said first pair of outrigger wheels are offset from said first riding wheel in a direction toward said trailing end.

11. The riding device of claim 10, wherein said second pair of outrigger wheel assemblies is offset from said second riding wheel in a direction toward said trailing end.

* * * * *

UNITED STATES PATENT AND TRADEMARK OFFICE

CERTIFICATE OF CORRECTION

PATENT NO. : 7,000,930 B2
APPLICATION NO. : 10/447902
DATED : February 21, 2006
INVENTOR(S) : Smith It is certified that error appears in the above-identified patent and that said Letters Patent is hereby corrected as shown below:

Column 2

Line 41, reads "...is perspective end view of..." and should read -- ...is a perspective end view of… --.

Column 6

Lines 17-18, reads "The pair of...further include four..., wherein a pair of...are secured along the..." and should read -- The pair of...further includes four..., wherein a pair of...is secured along the… --.

Column 8

Line 2, claim 10, reads "...surface of said platform and;..." and should read -- ...surface of said platform; and… --.

Line 6, claim 10, reads "...said outrigger wheel assembly assemblies biased..." and should read -- ...said outrigger wheel assemblies biased… -- .

Signed and Sealed this

Twenty-first Day of August, 2007

JON W. DUDAS
*Director of the United States Patent and Trademark Office*